US011840774B1

(12) United States Patent
Lin et al.

(10) Patent No.: US 11,840,774 B1
(45) Date of Patent: Dec. 12, 2023

(54) ONE-STEP CHITOSAN FIBER SPINNING DEVICE

(71) Applicant: Wenzhou Jiayuan Biotechnology Co. LTD, Wenzhou (CN)

(72) Inventors: Liang Lin, Wenzhou (CN); Xinxu Yan, Wenzhou (CN); Rui Han, Wenzhou (CN); Peng Guo, Wenzhou (CN)

(73) Assignee: WENZHOU JIAYUAN BIOTECHNOLOGY CO. LTD, Wenzhou (CN)

( * ) Notice: Subject to any disclaimer, the term of this patent is extended or adjusted under 35 U.S.C. 154(b) by 0 days.

(21) Appl. No.: 18/328,772

(22) Filed: Jun. 5, 2023

(30) Foreign Application Priority Data

Sep. 27, 2022 (CN) ..... 202211180509.X

(51) Int. Cl.
*D01D 10/06* (2006.01)
*D01D 5/06* (2006.01)

(52) U.S. Cl.
CPC ..... *D01D 5/06* (2013.01); *D01D 10/06* (2013.01); *D10B 2331/30* (2013.01)

(58) Field of Classification Search
CPC ..... D01D 5/06; D01D 5/0046; D01D 10/06
See application file for complete search history.

(56) References Cited

U.S. PATENT DOCUMENTS

2009/0091056 A1 4/2009 Fabbricante et al.
2009/0286074 A1* 11/2009 Kim ..... D01D 5/0046 428/338
2012/0086154 A1* 4/2012 Lennhoff ..... D01D 5/06 425/71
2012/0228797 A1* 9/2012 Wu ..... D01F 6/74 264/184
2013/0183525 A1* 7/2013 Wu ..... D01D 1/106 428/397
2014/0170256 A1 6/2014 Tai
2014/0232036 A1 8/2014 Inada et al.
2016/0186365 A1* 6/2016 Taylor ..... D01D 5/14 264/29.2
2018/0044187 A1* 2/2018 Pico ..... D21H 13/40
2019/0127887 A1* 5/2019 Tascan ..... D01D 13/02
2019/0292683 A1* 9/2019 Sun ..... D01D 10/06
2020/0332442 A1* 10/2020 Schrempf ..... D01D 7/00
2021/0252573 A1* 8/2021 Yu ..... B21C 1/32
2021/0285130 A1* 9/2021 Guardiani ..... D01D 10/0472
2021/0395317 A1* 12/2021 Abe ..... C07K 14/43586
2022/0112628 A1* 4/2022 Hagström ..... D01F 1/10
(Continued)

*Primary Examiner* — Emmanuel S Luk
(74) *Attorney, Agent, or Firm* — Zhigang Ma

(57) ABSTRACT

The present disclosure discloses a one-step chitosan fiber spinning device, including a stand; a stock solution tank, a coagulating bath, a plasticizing stretch bath, a water washing basin, a drying mechanism and a winding mechanism; a front end of a water conveying pipe is fixed on an inner wall of a front end of the water washing basin; a bearing at a front end of a mounting sleeve is mounted on the inner wall of the front end of the water washing basin; activity slots are formed in outer ends of mounting plates; a control head is fixed at an outer end of a control head seat; one end of a two-shaft motor is connected with a gear; a water tank is mounted at a top of a rear end of the water conveying pipe.

8 Claims, 7 Drawing Sheets

(56) References Cited

U.S. PATENT DOCUMENTS

| | | | | |
|---|---|---|---|---|
| 2022/0127755 | A1* | 4/2022 | Ando | D01F 4/00 |
| 2022/0136137 | A1* | 5/2022 | Tascan | D01D 5/06 428/221 |
| 2022/0340622 | A1* | 10/2022 | Jones | D01F 4/00 |
| 2022/0411971 | A1* | 12/2022 | Han | C09C 3/006 |
| 2023/0033537 | A1* | 2/2023 | Kim | C07K 14/78 |
| 2023/0039765 | A1* | 2/2023 | Ishii | D02J 1/229 |
| 2023/0272559 | A1* | 8/2023 | Bengtsson | D01F 2/00 423/447.5 |

* cited by examiner

ONE-STEP CHITOSAN FIBER SPINNING DEVICE

TECHNICAL FIELD

The present disclosure relates to the technical field of chitosan fiber spinning, specifically to a one-step chitosan fiber spinning device.

BACKGROUND

Chitosan fibers are fibers made after deacetylation with concentrated alkali, which have effects of inhibiting bacteria, stopping bleeding, promoting wound healing and the like. Chitosan is an important derivative of chitin, and chitin widely exists in shells of shrimps, crabs, and insects, and cytoderms of algae. Common methods for preparing chitosan fibers include wet spinning, dry and wet spinning, and electrostatic spinning. In the wet spinning process, a chitosan raw material is first dissolved in an acetic acid aqueous solution, and is then filtered and defoamed to prepare a spinning stock solution with a certain viscosity; a trickling stock solution is extruded from a spinning jet via a metering pump, and is coagulated into a solid fiber in a coagulating bath; and the solid fiber is further stretched one step to obtain a finished fiber product. The one-step spinning process with continuity is used in most cases. However, an existing one-step spinning device has the following problems during use:

In order to improve the fiber molding performance, most existing one-step spinning devices require plasticizing stretch and water bath stretch. During the water bath stretching, since a plasticized fiber bundle will carry a lot of solvent, the solvent needs to be cleared away by water washing and extrusion, and further molding is required. However, by the existing one-step spinning devices, it is inconvenient to uniformly pull the fiber bundle and perform water washing at matching positions during the water bath operation. The accumulated fiber bundle is only extruded by a tension roller and washed with water, so that the solvent in it is hard to clean, which affects the subsequent molding. As a result, the quality of chitosan fiber spinning decreases.

In response to the above problems, an innovative design is urgently needed on the basis of the existing one-step spinning device.

SUMMARY

The present disclosure aims to provide a one-step chitosan fiber spinning device, to solve the problem that it is inconvenient to uniformly pull apart a fiber bundle and perform alignment water washing by an existing one-step spinning device in the background. The present disclosure provides a solution that is significantly different from the prior art, to solve the technical problem in the prior art.

In order to achieve the above objective, the present disclosure provides the following technical scheme: A one-step chitosan fiber spinning device includes a stand; a stock solution tank, a coagulating bath, a plasticizing stretch bath, a water washing basin, a drying mechanism and a winding mechanism are mounted on the stand in sequence from left to right; a spinning jet is mounted on a left side wall of the coagulating bath, and a metering pump is connected between the spinning jet and the stock solution tank; and tension rollers are mounted in the coagulating bath, the plasticizing stretch bath and the water washing basin.

The one-step chitosan fiber spinning device further includes:

a water conveying pipe, wherein a front end of the water conveying pipe is fixed on an inner wall of a front end of the water washing basin; a rear end of the water conveying pipe is located on an outer side of a rear end of the water washing basin in a manner of penetrating through the water washing basin; a mounting sleeve rotatably sleeves the water conveying pipe, and the water conveying pipe is located between two tension rollers that are distributed in a height direction; a bearing at a front end of the mounting sleeve is mounted on the inner wall of the front end of the water washing basin; a rear end of the mounting sleeve is located on the outer side of the rear end of the water washing basin in a manner of penetrating through the water washing basin; mounting plates are fixed on an outer side of the mounting sleeve; activity slots are formed in outer ends of the mounting plates; screws are mounted in the activity slots through bearings; control head seats sleeve the screws through threads; control heads are fixed at outer ends of the control head seats; point-like bulges are adhered to side surfaces of the control heads; rear ends of the screws are connected with tooth rollers; two racks are arranged at side edge positions of the tooth rollers; the racks are fixed on the inner wall of a rear side of the water washing basin; a supporting seat is fixed outside the rear side of the water washing basin; a two-shaft motor is fixedly embedded inside the supporting seat; one end of the two-shaft motor is connected with a gear; a gear ring is meshed with an upper portion of the gear; and the gear ring sleeves the rear end of the mounting sleeve; and a water tank, wherein the water tank is mounted at a top position of the rear end of the water conveying pipe; a water inlet communicated with a bottom of the water tank is formed in the top position of the rear end of the water conveying pipe; a rear end surface of the water conveying pipe is connected with a pressure plate through an elastic telescopic rod; a center of the pressure plate is connected with a piston plate through a transverse rod; the piston plate is located in the water conveying pipe; a guide plate is arranged at a rear end of the pressure plate; the guide plate is connected to the other end of the double-shaft motor; a water inlet hole is formed in an inner wall of the water conveying pipe in a penetrating manner, and a water guide cavity is arranged on an outer side of the water inlet hole; the water guide cavity is formed in an inner wall of the mounting sleeve; the mounting plates on the outer side of the mounting sleeve are internally hollow and are communicated with the water guide cavity; and water spraying holes are formed in left side surfaces of the mounting plates at equal intervals and are communicated with the hollow portions inside the mounting plates.

Preferably, the water guide cavity is of a cambered structure; an arc length of the water guide cavity is greater than a diameter of the water inlet hole; the water inlet hole is arranged at a lower left portion that is at an angle of about 30° of the water conveying pipe; and a rubber material is paved on the inner wall of the mounting sleeve on the outer side of the water conveying pipe to abut against the water conveying pipe. When the water guide cavity overlaps the water inlet hole, water in the water conveying pipe enters the water guide cavity and is then sprayed via the water spraying holes to wash the fiber bundle. Meanwhile, the mounting sleeve rotates on the water conveying pipe, so that water will not leak from other abutting positions.

Preferably, the mounting plates are distributed on the outer side of the mounting sleeve at equal angles; a section of an outer end of each mounting plate in the front view is of a spherical structure; a height of each mounting plate is greater than a vertical distance between the mounting sleeve and a fiber bundle on the tension rollers; and the control head seats on the various mounting plates are offset. The mounting sleeve drives the mounting plates to rotate. When the mounting plates are in contact with the fiber bundle, the fiber bundle can be pressed to a certain extent to increase the tension and improve the molding efficiency. By cooperation with water washing, the cleaning effect is improved.

Preferably, the control head seats slide in the activity slots through the screws in an abutting manner; threads at two ends of the screws have opposite directions; and screw pitches on the screws gradually increase from the middle to both sides. The screws rotate to drive the control head seats on both sides to move towards the outer side. Meanwhile, due to the setting of the densities of the threads, the control head seats can move in an equal proportion, and distances between the various control head seats gradually increase.

Preferably, the point-like bulges of a hemispherical structure are distributed on outer side surfaces of the control heads at equal spacings; diameters of the point-like bulges gradually increase in a direction towards the outer ends of the control heads; widths of the outer side surfaces of the control heads gradually decrease in the direction towards the outer ends; and the control heads and the point-like bulges are both made of rubber materials. The control heads pull the fiber bundle apart, and cooperate with the point-like bulges to perform fibration on the fiber bundle. Due to the elasticity, the control heads can spring back in sequence when the fiber bundle is tensioned.

Preferably, the two racks form a cambered structure and are arranged at interior opposite corners of the water washing basin; the two racks are meshed with the tooth rollers; the lower rack is arranged outside the tooth rollers, and the upper rack is arranged inside the tooth rollers; and a tangent line of center points of the racks is parallel to the position of the fiber bundle on the tension rollers. When the mounting sleeve rotates clockwise, the tooth rollers are meshed with the lower rack to rotate anticlockwise, which drives the screws to rotate, so that the control head seats move towards the outside. When the tooth rollers are meshed with the upper rack, the screws drive the control head seats to be reset, which facilitates a next operation. Meanwhile, due to the distribution of the racks, the control head seats move towards the outside when in contact with the fiber bundle, to pull apart the fiber bundle.

Preferably, a side section of the piston plate is of an "L"-shaped structural design; a top of the piston plate abuts against the inner wall of the top of the water conveying pipe; the piston plate corresponds to the position of the water inlet; and two ends of the water conveying pipe are blocking structures. Reciprocating movement of the piston plate can extrude the water in the water conveying pipe, and it is convenient for water in the water tank to enter the water conveying pipe.

Preferably, the guide plate is parallel to the pressure plate; half of the guide plate is designed to be a bulge structure; a movement trajectory of the bulge position of the guide plate is in contact with the pressure plate; and an end portion of the bulge position of the guide plate is designed to be an inclined structure. Rotation of the guide plate and use of the elastic telescopic rod can drive the pressure plate to do reciprocating motion, thus driving the piston plate to do reciprocating motion.

Compared with the prior art, the present disclosure has the following beneficial effects:

1. In the present disclosure, a uniform fiber bundle pulling mechanism is provided. The two-shaft motor drives the mounting sleeve to rotate, which can drive the mounting plates to rotate. The tooth rollers outside the mounting plates are meshed with the lower rack, to drive the screws to rotate, thereby driving the control head seats to move to both sides in equal proportions. At this time, the control heads are plugged into the fiber bundle to push the fiber bundle from the middle to both sides, and the fiber bundle is divided into a plurality of small strands placed between the point-like bulges. The point-like bulges and the control heads are made of the rubber materials, which have certain softness. When the fiber bundle is pulled apart to a tensioning position, the point-like bulges and the control heads are stressed to deform, so that the tensioned fiber bundle is reset. Since the outer side of the end portion of each shifting block is of an inclined structure, the upper layer of fiber bundle is stretched farther away than the lower layer of fiber bundle, and the upper layer of fiber bundle is first tensioned and reset. At the same time, the upper layer of point-like bulge has a large diameter, so that the upper layer of fiber bundle is directly reset from the outer end of the lower point-like bulge, without driving the lower fiber bundle to be reset. By this structure, the accumulated fiber bundle can be pulled apart, and the fiber bundle that has not been pulled apart will not be brought back to its original position. This can achieve short-time uniform pulling of the fiber bundle, and facilitates uniform water washing in the later stage. In the traditional technology, the fiber bundle is immersed in water in most cases, and is then pressed and washed in water with the tension rollers, making it difficult to remove residual solvents inside the fiber bundle. Furthermore, in the present disclosure, when the fiber bundle is uniformly pulled apart, the fiber bundle is first extruded downwards through the outer ends of the mounting plates for vertical stretching. In the pulling process, the fiber bundle is pushed to both sides for horizontal stretching. By the multi-directional stretching, the molding efficiency of the fiber bundle is further improved.

2. In the present disclosure, an alignment water washing mechanism is provided. The two-shaft motor runs to uniformly pull apart the fiber bundle, and can drive the guide plate to rotate. Concave and convex positions on the guide plate can cooperate with the elastic telescopic rod to drive the pressure plate to do reciprocating sliding, thereby driving the piston plate to do reciprocating motion in the water conveying pipe. With the "L"-shaped section of the piston plate, it is also convenient to supplement the water conveying pipe with the water in the water tank during the extrusion of the water in the water conveying pipe. When the water in the water conveying pipe is extruded, the water guide cavity rotates to the water inlet hole, so that the water is sprayed from the water spraying holes through the water guide cavity. The arc length of the water guide cavity is greater than the diameter of the water inlet hole, so that the water spraying time can be prolonged, and the water is sprayed to the fiber bundle that is uniformly pulled apart to wash the fiber bundle. The single two-shaft motor is used with the structural design to synchronously wash the pulled-apart fiber bundle. Compared with the traditional technology for directly cleaning the fiber bundle in a water bath, the present disclosure uniformly sprays the water to the pulled-apart fiber bundle. On the one hand, water is saved; and on the other hand, uniform water washing and a good water washing effect are achieved. Furthermore, by controlling the speed of the two-shaft motor and increasing the pulling speed, the pulling operation can be performed within a very short fiber bundle distance for multiple times. The control head seats on the various mounting plates are offset. By adjusting the initial plugging position into the fiber bundle, the pulling position can be adjusted to further improve the uniformity of pulling of the fiber bundle.

Figure 1:
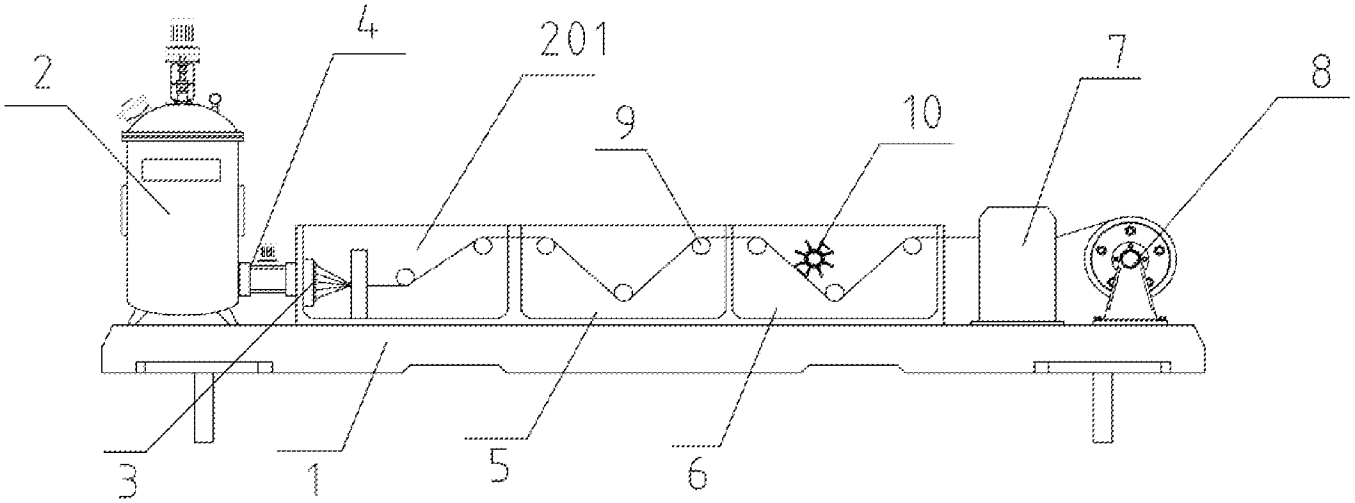
FIG. 1 is a front sectional diagram of a structure of the present disclosure.

In the drawings: 1: stand; 2: stock solution tank; 201: coagulating bath; 3: spinning jet; 4: metering pump; 5: plasticizing stretch bath; 6: water washing basin; 7: drying mechanism; 8: winding mechanism; 9: tension roller; 10: water conveying pipe; 101: mounting sleeve; 102: water inlet hole; 103: water guide cavity; 104: water spraying hole; 11: mounting plate; 12: activity slot; 13: screw; 14: control head seat; 15: control head; 16: point-like bulge; 17: tooth roller; 18: rack; 19: supporting seat; 20: two-shaft motor; 21: gear; 22: gear ring; 23: water tank; 24: water inlet; 25: elastic telescopic rod; 26: pressure plate; 27: transverse rod; 28: piston plate; and 29: guide plate.

DETAILED DESCRIPTION OF THE EMBODIMENTS

The technical solutions in the embodiments of the present disclosure will be described clearly and completely below in combination with the accompanying drawings of the embodiments of the present disclosure. Apparently, the described embodiments are only part of the embodiments of the present disclosure, not all embodiments. All other embodiments obtained by those of ordinary skill in the art based on the embodiments in the present disclosure without creative work shall fall within the protection scope of the present disclosure.

Figure 2:
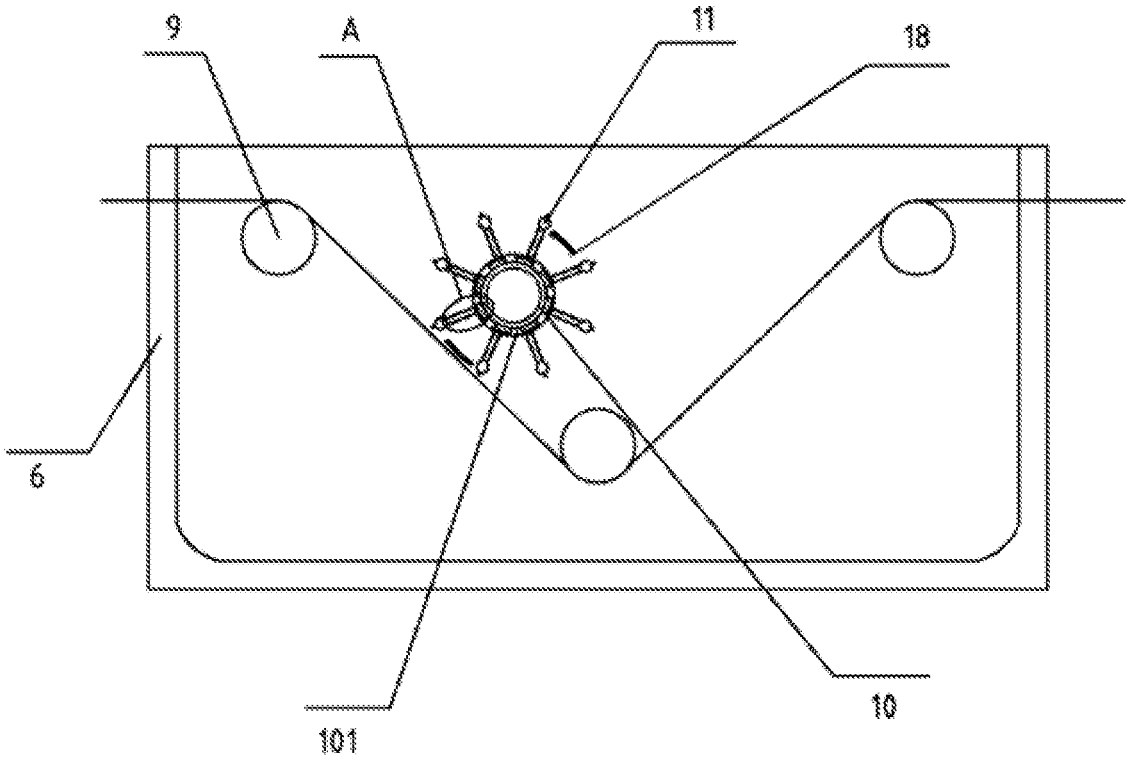
FIG. 2 is a schematic diagram of a front sectional structure of a water washing basin of the present disclosure.
Figure 3:
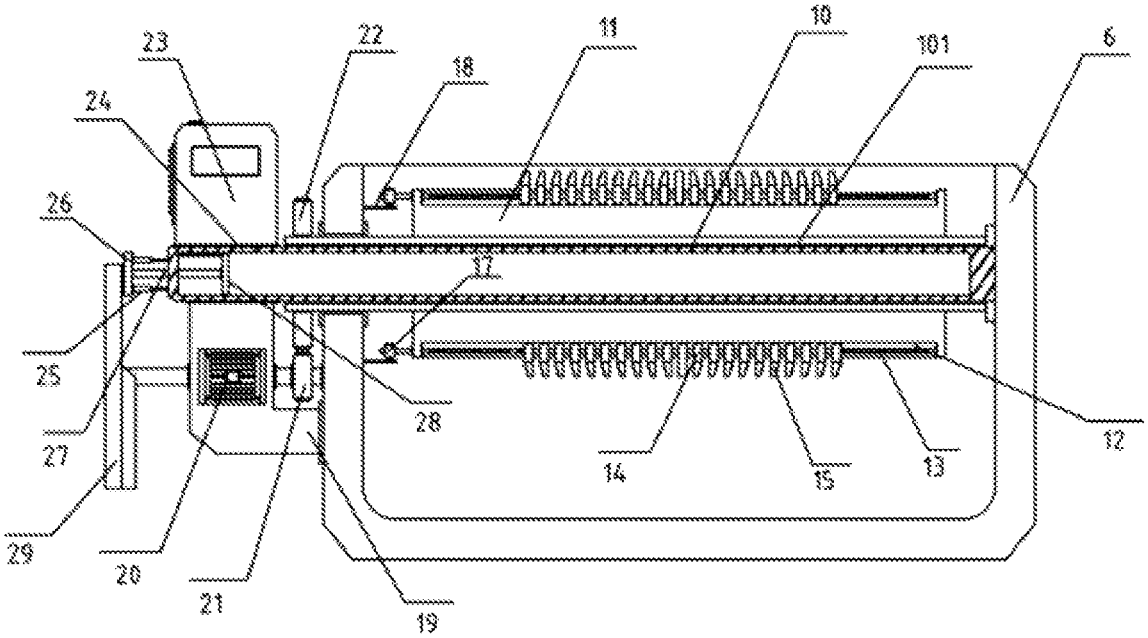
FIG. 3 is a schematic diagram of a side sectional structure of a water washing basin of the present disclosure.
Figure 4:
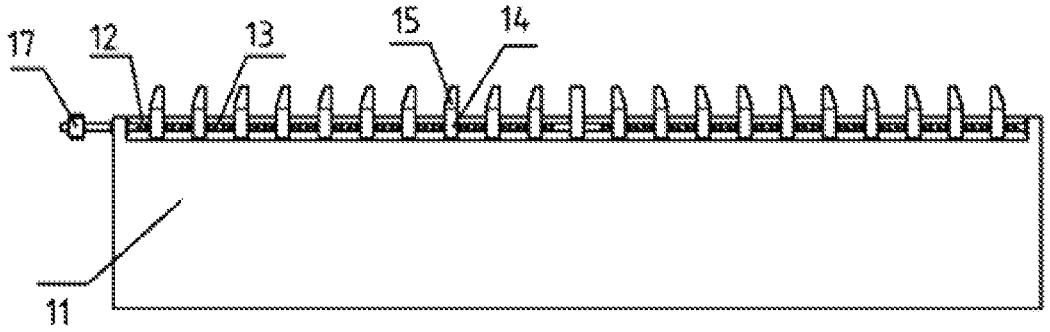
FIG. 4 is a schematic diagram of a deployable structure of a side surface of a control head seat of the present disclosure.
Figure 5:
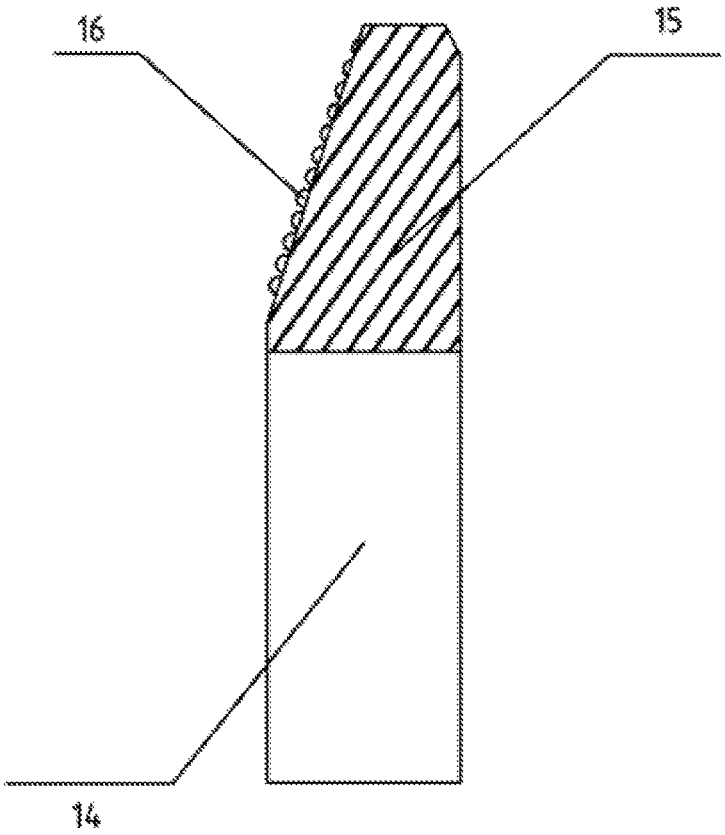
FIG. 5 is a schematic structural diagram of a side surface of a control head seat of the present disclosure.
Figure 6:
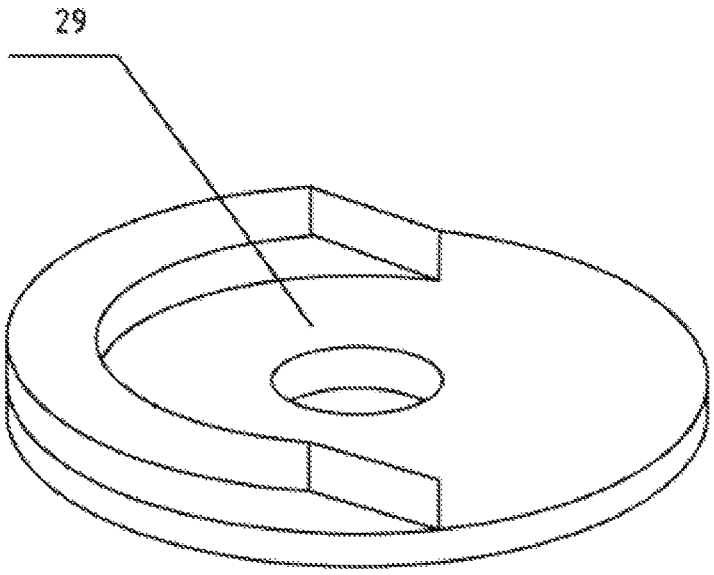
FIG. 6 is a schematic diagram of a three-dimensional structure of a guide plate of the present disclosure.
Figure 7:
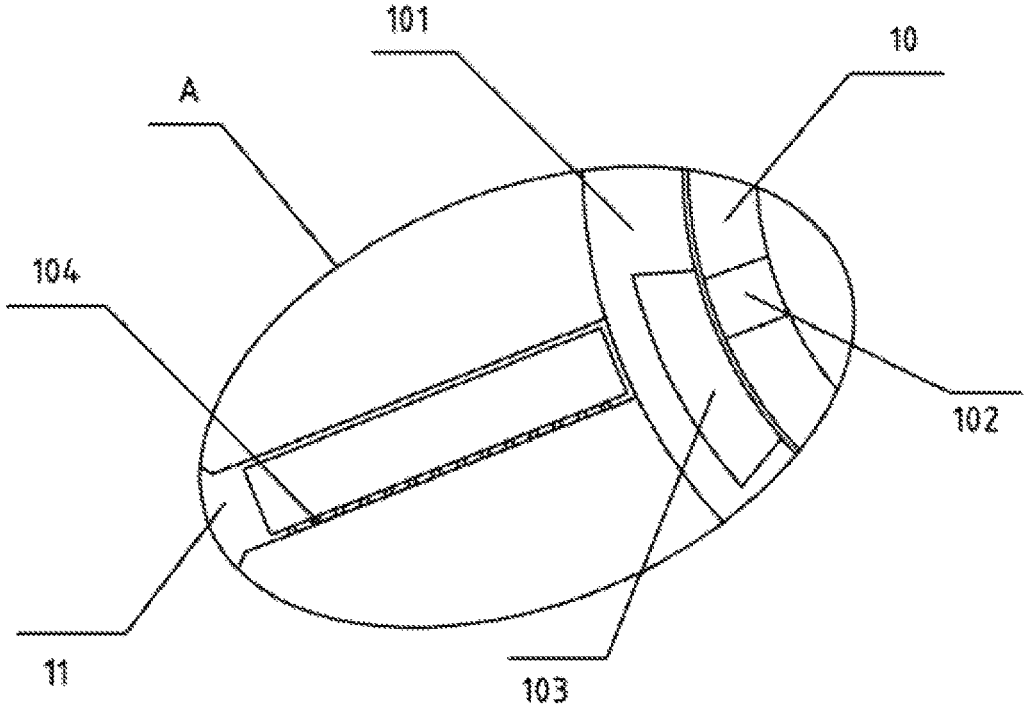
FIG. 7 is a schematic diagram of an enlarged structure of a portion A of the present disclosure in FIG. 2.

Referring to FIG. 1 to FIG. 7, the present disclosure a technical scheme: A one-step chitosan fiber spinning device includes a stand 1, a stock solution tank 2, a coagulating bath 201, a spinning jet 3, a metering pump 4, a plasticizing stretch bath 5, a water washing basin 6, a drying mechanism 7, a winding mechanism 8, tension rollers 9, a water conveying pipe 10, a mounting sleeve 101, a water inlet hole 102, a water guide cavity 103, water spraying holes 104, mounting plates 11, activity slots 12, screws 13, control head seats 14, control heads 15, point-like bulges 16, tooth rollers 17, racks 18, a supporting seat 19, a two-shaft motor 20, a gear 21, a gear ring 22, a water tank 23, a water inlet 24, an elastic telescopic rod 25, a pressure plate 26, a transverse rod 27, a piston rod 28 and a guide plate 29.

Embodiment 1

Referring to FIG. 1 to FIG. 5, a stock solution tank 2, a coagulating bath 201, a plasticizing stretch bath 5, a water washing basin 6, a drying mechanism 7 and a winding mechanism 8 are mounted on a stand 1 in sequence from left to right. A spinning jet 3 is mounted on a left side wall of the coagulating bath 201, and a metering pump 4 is connected between the spinning jet 3 and the stock solution tank 2. Tension rollers 9 are mounted in the coagulating bath 201, the plasticizing stretch bath 5 and the water washing basin 6. A front end of the water conveying pipe 10 is fixed on an inner wall of a front end of the water washing basin 6. A rear end of the mounting sleeve 10 is located on the outer side of the rear end of the water washing basin 6 in a manner of penetrating through the water washing basin, and a mounting sleeve 101 rotatably sleeves the water conveying pipe 10. The water conveying pipe 10 is located between two tension rollers 9 that are distributed in a height direction. A bearing at a front end of a mounting sleeve 101 is mounted on the inner wall of the front end of the water washing basin 6, and a rear end of the mounting sleeve 101 is located on the outer side of the rear end of the water washing basin 6 in a manner of penetrating through the water washing basin. Mounting plates 11 are fixed on an outer side of the mounting sleeve 101. Activity slots 12 are formed in outer ends of the mounting plates 11. Screws 13 are mounted in the activity slots 12 through bearings. Control head seats 14 sleeve the screws 13 through threads, and control heads 15 are fixed at outer ends of the control head seats 14. Point-like bulges 16 are adhered to side surfaces of the control heads 15. Rear ends of the screws 13 are connected with tooth rollers 17. Two racks 18 are arranged at side edge positions of the tooth rollers 17. The racks 18 are fixed on the inner wall of a rear side of the water washing basin 6. A supporting seat 19 is fixed outside the rear side of the water washing basin 6. A two-shaft motor 20 is fixedly embedded inside the supporting seat 19. One end of the two-shaft motor 20 is connected with a gear 21. A gear ring 22 is meshed with an upper portion of the gear 21, and the gear ring 22 sleeves the rear end of the mounting sleeve 101. The mounting plates 11 are distributed on the outer side of the mounting sleeve 101 at equal angles. A section of an outer end of each mounting plate 11 in the front view is of a spherical structure. A height of each mounting plate 11 is greater than a vertical distance between the mounting sleeve 101 and a fiber bundle on the tension rollers 9. The control head seats 14 on the various mounting plates 11 are offset. The control head seats 14 slide in the activity slots 12 through the screws 13 in an abutting manner. Threads at two ends of the screws 13 have opposite directions; and screw pitches on the screws 13 gradually increase from the middle to both sides. The point-like bulges 16 of a hemispherical structure are distributed on outer side surfaces of the control heads 15 at equal spacings. Diameters of the point-like bulges 16 gradually increase in a direction towards the outer ends of the control heads 15. Widths of the outer side surfaces of the control heads 15 gradually decrease in the direction towards the outer ends; and the control heads 15 and the point-like bulges 16 are both made of rubber materials. The two racks 18 form a cambered structure and are arranged at interior opposite corners of the water washing basin 6. The two racks 18 are meshed with the tooth rollers 17. The lower rack 18 is arranged outside the tooth rollers 17. The upper rack (18) is arranged inside the tooth rollers 17. A tangent line of center points of the racks 18 is parallel to the position of the fiber bundle on the tension rollers 9. The mounting sleeve 101 rotates to drive the mounting plates 11 to rotate. The tooth rollers 17 are meshed with the lower rack 18. The screws 13 drive the control head seats 14 to move towards both sides, to pull apart the fiber bundle by cooperation with the control heads 15 and the point-like bulges 16, which facilitates subsequent water washing.

Embodiment 2

Referring to FIG. 1 to FIG. 3 and FIG. 6 to FIG. 7, a water tank 23 is mounted at a top position of a rear end of the water conveying pipe 10. A water inlet 24 communicated with a bottom of the water tank 23 is formed in the top position of the rear end of the water conveying pipe 10. A rear end surface of the water conveying pipe 10 is connected with a pressure plate 26 through an elastic telescopic rod 25. A center of the pressure plate 26 is connected with a piston plate 28 through a transverse rod 27. The piston plate 28 is located in the water conveying pipe 10. A guide plate 29 is arranged at a rear end of the pressure plate 26. The guide plate 29 is connected to the other end of the double-shaft motor 20. A water inlet hole 102 is formed in the inner wall of the water conveying pipe 10 in a penetrating manner, and a water guide cavity 103 is arranged on an outer side of the water inlet hole 102. The water guide cavity 103 is formed in an inner wall of the mounting sleeve 101. The mounting plates 11 on the outer side of the mounting sleeve 101 are internally hollow and are communicated with the water guide cavity 103. Water spraying holes 104 are formed in left side surfaces of the mounting plates 11 at equal intervals and are communicated with the hollow structures inside the mounting plates 11. The water guide cavity 103 is of a cambered structure; an arc length of the water guide cavity 103 is greater than a diameter of the water inlet hole 102. The water inlet hole 102 is arranged at a lower left portion that is at an angle of about 30° of the water conveying pipe 10. A rubber material is paved on the inner wall of the mounting sleeve 101 on the outer side of the water conveying pipe 10 to abut against the water conveying pipe 10. A side section of the piston plate 28 is of an "L"-shaped structural design, and a top of the piston plate 28 abuts against the inner wall of the top of the water conveying pipe 10. The piston plate 28 corresponds to the position of the water inlet 24; and two ends of the water conveying pipe 10 are blocking structures. The guide plate 29 is parallel to the pressure plate 26. Half of the guide plate 29 is designed to be a bulge structure. A movement trajectory of the bulge position of the guide plate 29 is in contact with the pressure plate 26. An end portion of the bulge position of the guide plate 29 is designed to be an inclined structure. The two-shaft motor 20 drives the guide plate 29 to rotate to push the pressure plate 26 to move. The piston plate 28 is driven to move by the transverse rod 27, to extrude the water in the water conveying pipe 10, so that the water is sprayed from the water spraying holes 104 through the water inlet hole 102 and the water guide cavity 103, to wash a pulled-apart fiber bundle.

A working principle is as follows: When this one-step chitosan fiber spinning device is used, as shown in FIG. 1 to FIG. 7, a chitosan raw material is first dissolved, filtered and defoamed in a stock solution tank 2; the metering pump 4 is turned on to spray stock solution into the coagulating bath 201 through the spinning jet 3. After entering the coagulating bath 201, the stock solution is molded into a fiber bundle, and is introduced into the plasticizing stretch bath 5 through the tension rollers 9. Glycerol and aqueous solution in the plasticizing stretch bath 5 cooperate with the tension rollers 9 to perform plasticizing stretch on the fiber bundle, and then the fiber bundle enters the water washing tank 6. The two-shaft motor 20 is turned on. The two-shaft motor 20 is meshed with the gear ring 22 through the gear 21 to drive the mounting sleeve 101 to rotate clockwise on the water conveying pipe 10, and the mounting sleeve 101 drives the mounting plates 11 to rotate. When the tooth rollers 17 on the outer sides of the mounting plates 11 rotate to the position of the lower rack 18, the screws 13 are driven to rotate anticlockwise in the activity slots 12, to drive the control head seats 14 to slide outward. At this time, the control heads 15 on the control head seats 14 are plugged into the fiber bundle. As the control head seats 14 and the control heads 15 slide outward, the fiber bundle is pulled apart outward. In the pulling process, the fiber bundle is further stretched, and a small fiber bundle is stuck between two point-like bulges 16. The point-like bulges 16 and the control heads 15 are made of the rubber materials, which have certain softness. When the fiber bundle is pulled apart to a tensioning position, since the outer sides of the end portions of the control heads 15 are of inclined structures, the upper layer of fiber bundle is stretched farther away than the lower layer of fiber bundle, and the upper layer of fiber bundle is reset first. The upper layer of point-like bulge 16 has a relatively large diameter, so that the upper layer of fiber bindle is directly reset from the outer end of the lower layer of point-like bulge 16, without driving the lower fiber bundle to be reset. By this structure, the fiber bundle that is not pulled apart will not be pulled to its original position. This can achieve short-time uniform pulling of the fiber bundle. As the mounting sleeve 101 continues to rotate, the control heads 15 are disengaged from the fiber bundle, and the fiber bundle is reset, completing a transient pulling operation. When the tooth rollers 17 on the outer sides of the mounting plates 11 rotates to the upper rack 18, the tooth rollers 17 rotate clockwise, which can drive the screws 13 to rotate in a reverse direction and drive the control head seats 14 to be reset, facilitating a next operation.

Next, in the process of pulling apart the fiber bundle by the control heads 15, the two-shaft motor 20 drives the guide plate 29 to rotate. The bulge position of the guide plate 29 is in contact with the pressure plate 26 to extrude the pressure plate 26, so that the pressure plate 26 drives the piston plate 28 to move in the water conveying pipe 10 through the transverse rod 27. A horizontal position on the piston plate 28 blocks the water inlet 24, and the water in the water tank 23 no longer flows into the water conveying pipe 10. The piston plate 28 then extrudes the water in the water conveying pipe 10. At this time, the water guide cavity 103 just rotates to the water inlet hole 102, so that the water in the water conveying pipe 10 enters the water guide cavity 103 through the water inlet hole 102, then enters internal cavities of the mounting plates 11 and is sprayed out through the water spraying holes 104. The water is sprayed to the pulled-apart fiber bundle, to achieve uniform water washing. As the guide plate 29 continues to rotate, the bulge position of the guide plate 29 is separated from the pressure plate 26. Under the action of the elastic telescopic rod 25, the pressure plate 26 is reset, which drives the piston plate 28 to be reset. The water inlet 24 is opened, and the water in the water tank 23 is supplemented into the water conveying pipe 10. Through the reciprocating motion of the piston plate 28, the fiber bundle is continuously pulled apart by the control heads 15, so that the fiber bundle is uniformly washed with water. At the same time, the end portions of the mounting plates 11 and the control heads 15 provide an additional tensile force to the fiber bundle, which improves the molding effect on the fiber bundle. The fiber bundle then enters the drying mechanism 7 for drying, and is wound through the winding mechanism 8.

The contents not described in detail in this specification belong to the existing technology known to the those skilled in the art. In the description of the present disclosure, unless otherwise stated, "plurality" means two or more. Orientations or positional relationships indicated by the terms "upper", "lower", "left", "right", "inside", "outside", "front end", "rear end", "head", "tail" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are construed as limiting the present disclosure. In addition, the terms "first", "second", "third", etc. are only for the purpose of description, and may not be understood as indicating or implying the relative importance. In the description of the present disclosure, it should be noted that unless otherwise explicitly defined and defined, the terms "connect" and "connected" are to be understood broadly, and may be, for example, fixedly connected, or detachably connected, or integrally connected, or mechanically connected, or electrically connected, or directly connected, or indirectly connected through an intermediate medium. Those of ordinary skill in the art can understand the specific meanings of the above terms in the present disclosure according to specific situations.

Although the present disclosure has been described in detail with reference to the foregoing embodiments, those skilled in the art still can modify the technical solutions disclosed in the foregoing various embodiments, or make equivalent replacement to partial technical features. Any modifications, equivalent replacements, improvements and the like that are made without departing from the spirit and principle of the present disclosure shall all fall within the protection scope of the present disclosure.

What is claimed is:

1. A one-step chitosan fiber spinning device, comprising a stand (1), wherein a stock solution tank (2), a coagulating bath (201), a plasticizing stretch bath (5), a water washing basin (6), a drying mechanism (7) and a winding mechanism (8) are mounted on the stand (1) in sequence from left to right; a spinning jet (3) is mounted on a left side wall of the coagulating bath (201), and a metering pump (4) is connected between the spinning jet (3) and the stock solution tank (2); tension rollers (9) are mounted in the coagulating bath (201), the plasticizing stretch bath (5) and the water washing basin (6);

the one-step chitosan fiber spinning device further comprises:

a water conveying pipe (10), wherein a front end of the water conveying pipe (10) is fixed on an inner wall of a front end of the water washing basin (6); a rear end of the water conveying pipe (10) is located on an outer side of a rear end of the water washing basin (6) in a manner of penetrating through the water washing basin; a mounting sleeve (101) rotatably sleeves the water conveying pipe (10), and the water conveying pipe (10) is located between two tension rollers (9) that are distributed in a height direction; a bearing at a front end of the mounting sleeve (101) is mounted on the inner wall of the front end of the water washing basin (6); a rear end of the mounting sleeve (101) is located on the outer side of the rear end of the water washing basin (6) in a manner of penetrating through the water washing basin; mounting plates (11) are fixed on an outer side of the mounting sleeve (101); activity slots (12) are formed in outer ends of the mounting plates (11); screws (13) are mounted in the activity slots (12) through bearings; control head seats (14) sleeve the screws (13) through threads; control heads (15) are fixed at outer ends of the control head seats (14); point-like bulges (16) are adhered to side surfaces of the control heads (15); rear ends of the screws (13) are connected with tooth rollers (17); two racks (18) are arranged at side edge positions of the tooth rollers (17); the racks (18) are fixed on the inner wall of a rear side of the water washing basin (6); a supporting seat (19) is fixed outside the rear side of the water washing basin (6); a two-shaft motor (20) is fixedly embedded inside the supporting seat (19); one end of the two-shaft motor (20) is connected with a gear (21); a gear ring (22) is meshed with an upper portion of the gear (21); and the gear ring (22) sleeves the rear end of the mounting sleeve (101);

a water tank (23), wherein the water tank (23) is mounted at a top position of the rear end of the water conveying pipe (10); a water inlet (24) communicated with a bottom of the water tank (23) is formed in the top position of the rear end of the water conveying pipe (10); a rear end surface of the water conveying pipe (10) is connected with a pressure plate (26) through an elastic telescopic rod (25); a center of the pressure plate (26) is connected with a piston plate (28) through a transverse rod (27); the piston plate (28) is located in the water conveying pipe (10); a guide plate (29) is arranged at a rear end of the pressure plate (26); the guide plate (29) is connected to the other end of the double-shaft motor (20); a water inlet hole (102) is formed in an inner wall of the water conveying pipe (10) in a penetrating manner, and a water guide cavity (103) is arranged on an outer side of the water inlet hole (102); the water guide cavity (103) is formed in an inner wall of the mounting sleeve (101); the mounting plates (11) on the outer side of the mounting sleeve (101) are internally hollow and are communicated with the water guide cavity (103); and water spraying holes (104) are formed in left side surfaces of the mounting plates (11) at equal intervals and are communicated with the hollow structure inside the mounting plates (11).

2. The one-step chitosan fiber spinning device according to claim 1, wherein the water guide cavity (103) is of a cambered structure; an arc length of the water guide cavity (103) is greater than a diameter of the water inlet hole (102); the water inlet hole (102) is arranged at a lower left portion that is at an angle of about 30° of the water conveying pipe (10); and a rubber material is paved on the inner wall of the mounting sleeve (101) on an outer side of the water conveying pipe (10) to abut against the water conveying pipe (10).

3. The one-step chitosan fiber spinning device according to claim 1, wherein the mounting plates (11) are distributed on the outer side of the mounting sleeve (101) at equal angles; a section of an outer end of each mounting plate (11) in a front view is of a spherical structure; a height of each mounting plate (11) is greater than a vertical distance between the mounting sleeve (101) and a fiber bundle on the tension rollers (9); and the control head seats (14) on the various mounting plates (11) are offset.

4. The one-step chitosan fiber spinning device according to claim 1, wherein the control head seats (14) slide in the activity slots (12) through the screws (13) in an abutting manner; threads at two ends of the screws (13) have opposite directions; and screw pitches on the screws (13) gradually increase from the middle to both sides.

5. The one-step chitosan fiber spinning device according to claim 1, wherein the point-like bulges (16) of a hemispherical structure are distributed on outer side surfaces of the control heads (15) at equal spacings; diameters of the point-like bulges (16) gradually increase in a direction towards the outer ends of the control heads (15); widths of the outer side surfaces of the control heads (15) gradually decrease in the direction towards the outer ends; and the control heads (15) and the point-like bulges (16) are both made of rubber materials.

6. The one-step chitosan fiber spinning device according to claim 1, wherein the two racks (18) form a cambered structure and are arranged at interior opposite corners of the water washing basin (6); the two racks (18) are meshed with the tooth rollers (17); the lower rack (18) is arranged outside the tooth rollers (17), and the upper rack (18) is arranged inside the tooth rollers (17); and a tangent line of center points of the racks (18) is parallel to the position of the fiber bundle on the tension rollers (9).

7. The one-step chitosan fiber spinning device according to claim 1, wherein a side section of the piston plate (28) is of an "L"-shaped structural design; a top of the piston plate (28) abuts against the inner wall of the top of the water conveying pipe (10); the piston plate (28) corresponds to the position of the water inlet (24); and two ends of the water conveying pipe (10) are blocking structures.

8. The one-step chitosan fiber spinning device according to claim 1, wherein the guide plate (29) is parallel to the pressure plate (26); half of the guide plate (29) is designed to be a bulge structure; a movement trajectory of the bulge position of the guide plate (29) is in contact with the pressure plate (26); and an end portion of the bulge position of the guide plate (29) is designed to be an inclined structure.

* * * * *